US006599094B2

(12) United States Patent
Kanazaki et al.

(10) Patent No.: US 6,599,094 B2
(45) Date of Patent: Jul. 29, 2003

(54) SCREW COMPRESSOR SYSTEM AND OPERATING METHOD THEREOF

(75) Inventors: Kazuya Kanazaki, Tsuchiura (JP); Shinichi Hirose, Chiyoda (JP); Junji Okita, Ishioka (JP); Seiji Tsuru, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/789,755

(22) Filed: Feb. 22, 2001

(65) Prior Publication Data

US 2002/0071769 A1 Jun. 13, 2002

(30) Foreign Application Priority Data

Sep. 20, 2000 (JP) ..... 2000-290347

(51) Int. Cl.[7] ..... F04B 49/00

(52) U.S. Cl. ..... 417/53; 417/53; 417/4; 417/44.2

(58) Field of Search ..... 417/53, 2, 3, 7, 417/12, 17, 286, 290, 426, 4, 216, 44.2, 44.4, 303, 304, 308, 310, 279, 285

(56) References Cited

U.S. PATENT DOCUMENTS

| | | | | |
|---|---|---|---|---|
| 3,775,995 A | * | 12/1973 | Conley et al. | 62/196 |
| 4,384,462 A | * | 5/1983 | Overman et al. | 62/175 |
| 4,580,947 A | * | 4/1986 | Shibata et al. | 417/8 |
| 5,108,263 A | * | 4/1992 | Blotenberg | 417/2 |
| 5,343,384 A | * | 8/1994 | Fisher et al. | 364/133 |
| 5,347,467 A | * | 9/1994 | Staroselsky et al. | 364/510 |
| 5,743,714 A | * | 4/1998 | Drob | 417/2 |
| 5,967,761 A | * | 10/1999 | Mehaffey | 417/286 |
| 6,287,083 B1 | * | 9/2001 | Hase et al. | 417/216 |

FOREIGN PATENT DOCUMENTS

| | | | |
|---|---|---|---|
| EP | 482592 | | 4/1992 |
| JP | 57044787 | * | 3/1982 |
| JP | 0482 592 A1 | * | 4/1992 |
| JP | 4159491 | | 6/1992 |
| JP | 161237 | | 6/2000 |

OTHER PUBLICATIONS

Karassik et al. "Pump Handbood", McGraw Hill Book Co. 2nd Ed. 1986, pp. 3.70, Fig. 17.*

Co–pending U.S. patent application "Screw Compressor" filed on Nov. 30, 2000, under Ser. No. 09/725,907.

Jpanese Patent Unexamined Publication No. 2000–161237.

Japanese Patent Unexamined Publication No. 4–159491.

Co–pending U.S. patent application Screw Compressor, filed on Nov. 30, 2000 of which Ser. No. has not been defined 09/725907.

* cited by examiner

*Primary Examiner*—Charles G. Freay
*Assistant Examiner*—Han Lieh Liu
(74) *Attorney, Agent, or Firm*—Antonelli, Terry, Stout & Kraus, LLP

(57) ABSTRACT

A screw compressor system comprises a plurality of screw compressors the capacity of each of which is controlled by repeating load operation and no-load operation. Using a timer output corresponding to compressed gas consumption in a demander including gas consumption equipments, a parent controller determines the number of compressors to be operated among the plurality of compressors. Among the compressors determined to be operated, all compressors other than one are put in load operation. In accordance with a load factor of the excepted one screw compressor, the parent controller controls discharge pressure of each compressor. At this time, the control is made so that discharge pressure of the screw compressor system measured by a pressure gauge be lower than that upon the maximum gas consumption.

11 Claims, 7 Drawing Sheets

SCREW COMPRESSOR SYSTEM AND OPERATING METHOD THEREOF

BACKGROUND OF THE INVENTION

The present invention relates to a screw compressor system and operating methods thereof wherein a plurality of screw compressors can be operated in parallel, in particular, a screw compressor system and operating methods thereof suitable for performing capacity control in response to an amount of consumption of compressed gas generated in the screw compressor system.

In relation to a compressed air production equipment comprising a plurality of screw compressors, in order to minimize the consumed power, use of one compressor whose rotational speed is variable in combination with a plurality of compressors each having a fixed rotational speed is disclosed in JP-A-2000-161237. In the compressed air production equipment disclosed in this publication, the rotational speed of the variable-speed compressor is controlled preferentially and then the plurality of fixed-speed compressors are operated and stopped by turn-back control or rotary control.

JP-A-4-159491 discloses that one screw compressor is used with the switching cycle between full load operation and no-load operation being changed so as to prevent wear and tear of parts due to frequent on/off-operations.

Since the compressed air production equipment disclosed in JP-A-2000-161237 include the variable-speed compressor, the equipment has an advantage that the equipment is highly efficient throughout a wide range of load factor, which is represented by the consumed gas volume relative to the rated discharged gas volume of a compressor, and the power consumption can be reduced. However, when the discharged gas volume of the equipment is increased, the capacity of the variable-speed compressor cannot but be increased accordingly. But, such a large-capacity variable-speed compressor is expensive. This brings about an in-convenience that the production cost of the compressed air production equipment is increased.

The screw compressor disclosed in JP-A-4-159491 is premised on being used alone. JP-A-4-159491 does not consider that a plurality of compressors are operated at once. Between such a screw compressor system for producing compressed gas and a demander, in general, there are passage parts such as filters, gas storage towers, and piping, wherein the passage resistance varies in accordance with the gas velocity flowing therein. In other words, the pressure loss in piping or the like reduces as the load factor reduces. Conventionally, the discharge pressure of such a compressor is set by taking into consideration with the pressure loss at the maximum flow rate. However, in order that the compressor may not consume excessive power, when the pressure loss reduces, it is desirable to set a suitable discharge pressure of the compressor accordingly.

BRIEF SUMMARY OF THE INVENTION

The present invention has been made in view of the inconveniences of the above prior arts and its object is to reduce shaft power in a screw compressor system comprising a plurality of load/no-load operation type screw compressors and realize power-saving operation.

A screw compressor system of the present invention to attain the above object is characterized by comprising control means for determining the number of screw compressors to be operated in accordance with the compressed gas consumption in a demander, putting, in the screw compressors to be operated, all second screw compressors other than one first screw compressor in load operation, and changing discharge pressure of each of the first and second screw compressors in accordance with the load factor of said first screw compressor.

In this characteristic feature, it is preferable that when the load factor of the first screw compressor has reduced, the control means reduces compressor discharge pressure upon load operation start and compressor discharge pressure upon no-load operation start respectively to be less than a rated compressor discharge pressure upon load operation start and a rated compressor discharge pressure upon no-load operation start predetermined in relation to the first screw compressor. Besides, it is preferable that when the reduced compressor discharge pressure upon load operation start is beyond a predetermined lower limit, the control means sets the compressor discharge pressure upon load operation start to that lower limit.

Further, it is preferable that when period from the load operation to subsequent load operation of the first screw compressor is beyond a predetermined time range, the control means lowers the compressor discharge pressure upon no-load operation start of the first screw compressor than the predetermined rated compressor discharge pressure upon no-load operation start.

Another screw compressor system of the present invention to attain the above object is characterized by comprising a plurality of compressors and in that a parent controller obtains a load factor on the basis of a cycle time measured by a timer, determines the number of screw compressors to be operated in accordance with that load factor, in the screw compressors determined to be operated, puts one screw compressor in load operation, controls the remaining one to repeat load operation and no-load operation, as for this one screw compressor, obtains a load factor on the basis of a cycle time newly measured by the timer, and changes the discharge pressure measured by discharge pressure measuring means in accordance with that load factor. It is preferable that the parent controller controls one screw compressor so that the discharge pressure measured by the discharge pressure measuring means is lowered when the load factor reduces.

An operating method of a screw compressor system of the present invention to attain the above object is characterized in that a load factor is obtained from the cycle time of load operation and no-load operation obtained by operating all screw compressors, the number of screw compressors to be operated is determined on the basis of that load factor, one of the screw compressors to be operated is operated to repeat load operation and no-load operation, the remaining screw compressors of the screw compressors to be operated are put in load operation, in relation to the screw compressor repeating load operation and no-load operation, a cycle time is newly measured to obtain a load factor, and the discharge pressure of the screw compressor repeating load operation and no-load operation is changed in accordance with that load factor.

In this characteristic feature, it is preferable that the discharge pressure upon load operation start and the discharge pressure upon no-load operation start of the screw compressor repeating load operation and no-load operation is lowered as the load factor reduces and further, when the discharge pressure upon load operation start of the screw compressor repeating load operation and no-load operation has reached a predetermined lower limit pressure, it is preferable that the discharge pressure upon load operation start is set at that lower limit value and the discharge pressure upon no-load operation start is changed.

Preferably, the discharge pressure is controlled by a parent controller provided for one of a plurality of compressors included in the screw compressor system and the parent controller controls child controllers respectively provided for the remaining screw compressors.

DETAILED DESCRIPTION OF THE INVENTION

Figure 1:
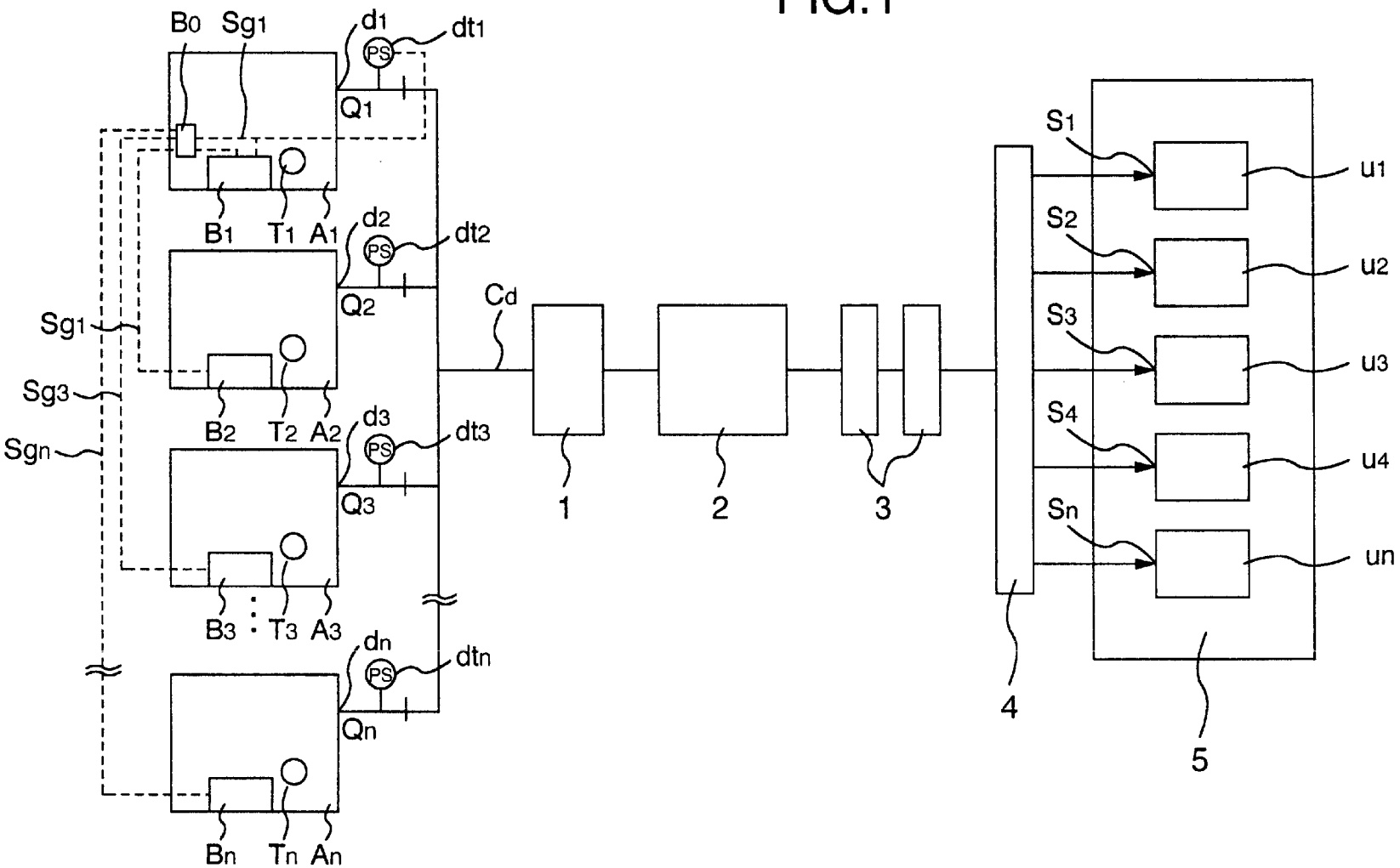
FIG. 1 is a block diagram showing an embodiment of a screw compressor system according to the present invention.

Hereinafter, some embodiments of the present invention will be described with reference to the accompanying drawings. FIG. 1 is a block diagram showing an embodiment of a screw compressor system according to the present invention. The screw compressor system comprises one parent screw compressor $A_1$ and a plurality of child screw compressors $A_2$ to $A_n$. For the child screw compressors $A_2$ to $A_n$, child controllers $B_2$ to $B_n$ are provided for controlling the respective child screw compressors. For the parent screw compressor $A_1$, a parent controller $B_1$ is provided for controlling the parent screw compressor $A_1$ and the child controllers $B_2$ to $B_n$.

Between the parent controller $B_1$ and the child controllers $B_2$ to $B_n$, a relay box $B_0$ is provided. To the relay box $B_0$, nine child controllers can be connected at the maximum. The parent controller $B_1$ is connected to the relay box $B_0$ through a wiring $S_{g1}$ and the relay box $B_0$ is connected to the respective child controllers $B_2$ to $B_n$ through wirings $S_{g2}$ to $S_{gn}$. A timer $T_1$ is provided for the parent controller $B_1$ and timers $T_2$ to $T_n$ are provided for the child controllers $B_2$ to $B_n$. To a discharge side $d_1$ of the parent compressor $A_1$ and discharge sides $d_2$ to $d_n$ of the child compressors $A_2$ to $A_n$, pressure gages $d_{t1}$ to $d_{tn}$, are attached for measuring the discharge side pressures.

The discharge side $d_1$ of the parent compressor $A_1$ and the discharge sides $d_2$ to $d_n$ of the child compressors $A_2$ to $A_n$ are connected through a discharge piping $C_d$ and gases compressed in the respective compressors $A_1$ to $A_n$ are collected in a gas holder 1 such as a gas storage tower. On the downstream side of the gas holder 1, provided is a gas separator for removing impurities from the compressed gas or a dehumidifier system 2 for removing, from the compressed gas, drain water generated when gas is compressed. On the downstream side of the gas separator or dehumidifier system 2, a filter 3 is provided for removing dust or the like from the compressed gas. Cleaned compressed gas from which dust components have been removed by the filter 3 is sent through a gas header 4 to suction sides $s_1$ to $s_m$ of units $u_1$ to $u_m$ of a demander 5.

The operation of this embodiment constructed as above will be described hereinafter. In this embodiment, there are one parent compressor, three child compressors, and five demander units. In accordance with operation conditions of the demander units $u_1$ to $u_5$, the load factor of the screw compressor system varies. The load factor $\Theta$ is represented by the ratio of the flow rate $\Sigma Q_i$ of gas consumed in the demander 5 to the maximum flow rates $Q_{1max}$ to $Q_{4max}$ ($m^3$/min) of the respective screw compressors. That is, $$\Theta=\Sigma Q_i/(Q_{1max}+Q_{2max}+Q_{3max}+Q_{4max}).$$

Figure 2:
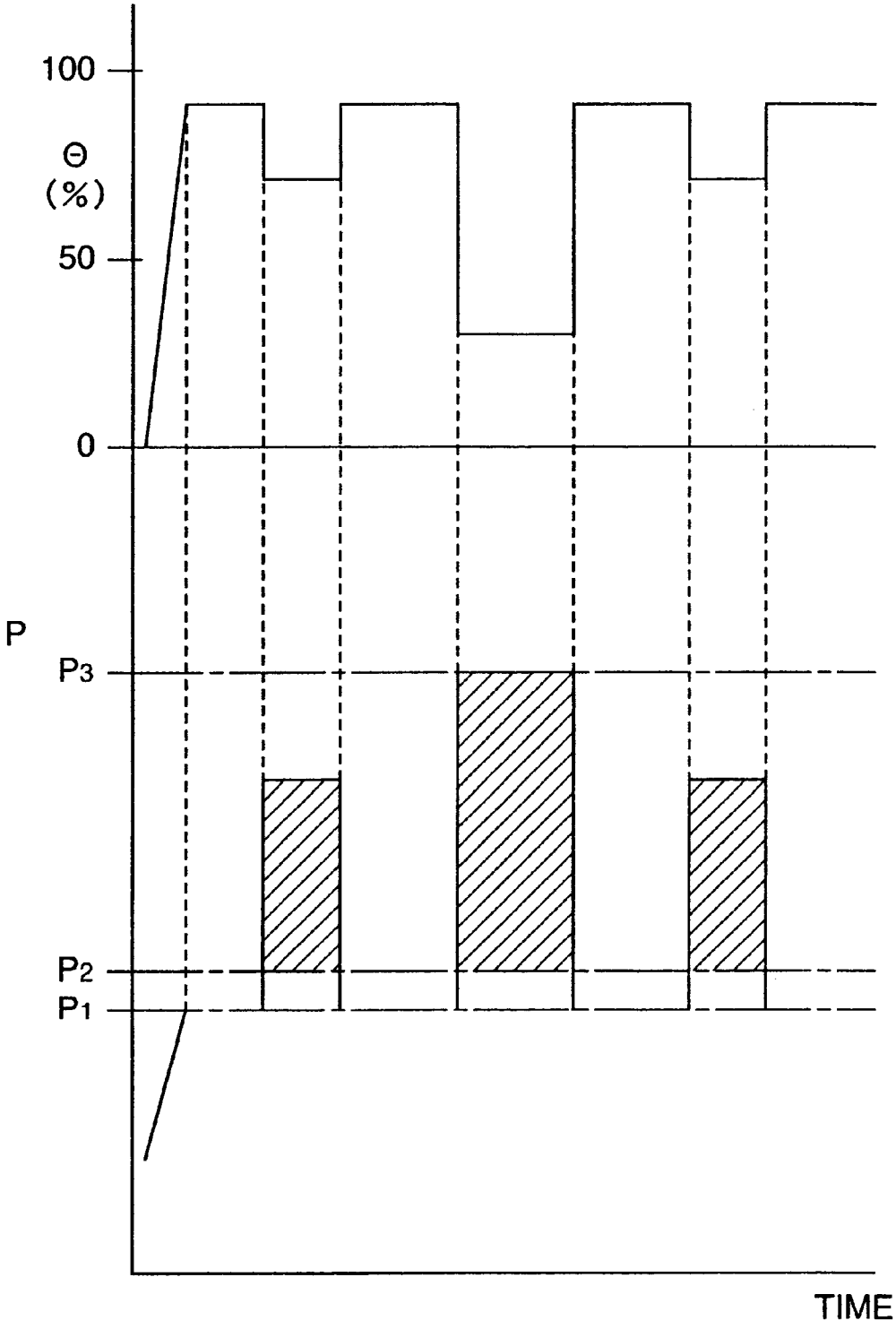
FIG.2 PRIOR ART
FIG. 2 is a graph illustrating the relation between load factor and operation conditions of a compressor of a compressor system of a prior art.

In a conventional screw compressor system, when the load factor changes as shown in the upper part of FIG. 2, for example, the discharge pressure of the parent compressor $A_1$ changes as shown in the lower part of FIG. 2. In the lower part of FIG. 2, $P_1$ represents a pressure required by the demander (end pressure), which pressure is ensured by the screw compressor system as its discharge pressure. This $P_1$ is set in consideration of various losses such as piping loss from the detection position by the pressure gage to the demander. $P_2$ is a value including buffer corresponding to the variation when operation conditions change attendant with capacity control or number control of the plurality of screw compressors $A_1$ to $A_4$. $P_3$ represents pressure upon no-load operation start during a screw compressor is capacity controlled. This $P_3$ is so set as to prevent wear and tear of devices due to frequent on/off-operations of the screw compressor. For example, in a screw compressor system whose discharge pressure is 0.7 MPa as gage pressure, $P_1$ is set at 0.7 MPa+x(x corresponds to passage resistance loss), $P_2$ is set at the pressure higher than $P_1$ by about 0.02 MPa, and $P_3$ is set at 0.8 MPa.

As apparent from FIG. 2, when the load factor on the demander 5 side reduces, the end pressure of the screw compressor system increases. This is caused also by that the gas consumption on the demander 5 side reduces and the piping pressure loss from the discharge sides $d_1$ to $d_4$ of the screw compressors $A_1$ to $A_4$ to the suction sides $s_1$ to $s_5$ of the units $u_1$ to $u_5$ of the demander 5 reduces. The pressure necessary for the screw compressor system is $P_1$ in any case. When the operations of the units $u_1$ to $U_5$ of the demander 5 are lowered and the load factor reduces, the portions between the pressures $P_3$ and $P_2$, shown by hatching in the lower part of FIG. 2, become quite useless compression. So, in the present invention, by reducing the portions shown by hatching in FIG. 2, shaft power of the screw compressor system reduces.

Figure 3:
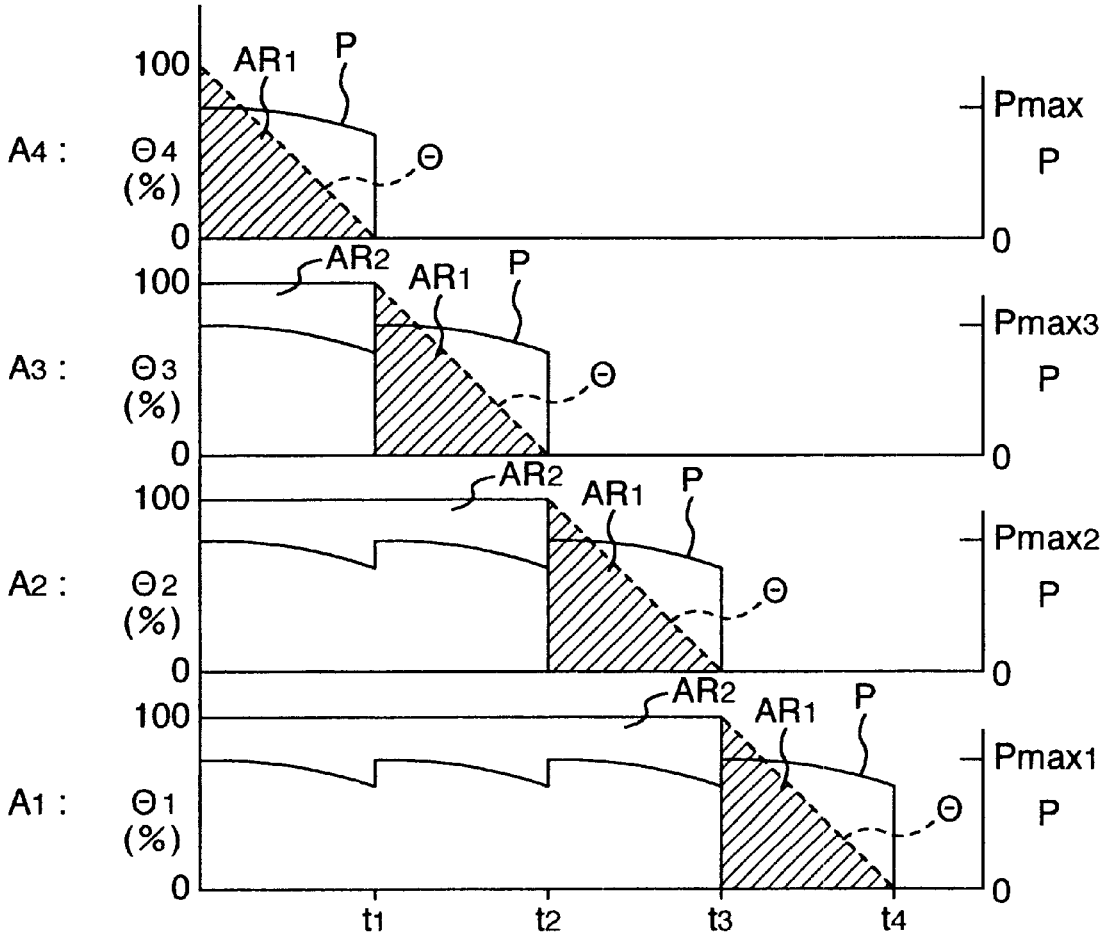
FIG. 3 is a graph illustrating the relation between load factor and discharge side pressure of a compressor system of the present invention.

The principle of this power reduction will be described with reference to FIG. 3. Employed is an example wherein the capacities of the parent screw compressor $A_1$ and three child screw compressors $A_2$ to $A_4$ are all the same. Suppose that the gas consumption of the demander changes in load factor $\Theta$ from 100% to 0%. When the load factor is 100%, since the gas consumption of the demander 5 can not be covered unless all the screw compressors are operated, all compressors are put in load operation. This timing is considered time 0. In a period between times 0 and $t_1$ in which the load factor $\Theta$ reduces from 100% to 75%, three screw compressors $A_1$ to $A_3$ are put in full load operation. This is shown by area $AR_2$ in FIG. 3. On the other hand, only one screw compressor $A_4$ is put in capacity-controlled operation. In this embodiment, the capacity-controlled operation is implemented by repeating load operation and no-load operation. This capacity-controlled operation is shown by area $AR_1$ in FIG. 3.

In a period between times $t_1$ and $t_2$ in which the load factor reduces from 75% to 50%, the compressor $A_4$ being in capacity-controlled operation is stopped and the compressor $A_3$ is newly put in capacity-controlled operation. At this time, the remaining two compressors $A_1$ and $A_2$ are kept in full load operation. In a period between times $t_2$ and $t_3$ in which the load factor further reduces from 50% to 25%, the compressor $A_3$ being in capacity-controlled operation is stopped and the compressor $A_2$ is newly put in capacity-controlled operation. At this time, the compressor $A_4$ is kept stopped and the compressor $A_1$ is kept in full load operation. In a period between times $t_3$ and $t_4$ in which the load factor reduces from 25% to 0%, the compressor $A_2$ is stopped and the compressor $A_1$ is put in capacity-controlled operation. The compressors $A_3$ and $A_4$ are kept stopped.

When a plurality of screw compressors are thus controlled in number, the discharge pressure of a compressor controlled in its capacity is changed in accordance with its load factor. The load factor of each compressor is 100% when it is in full load operation and 0% when it is out of operation. The load factor Θ of the screw compressor system is obtained using the following expressions from the load factor of of each compressor $A_k$ in capacity-controlled operation. The load factor $\Theta_k$ of each compressor is obtained from the gas consumption $\Sigma Q_i$ of the demander 5 and the maximum flow rate $Q_{maxj}$ of each compressor $A_j$ (j=1 to 4).

$$\Theta_i = \left\{\sum Q_j - \sum_k^{i-1} Q_{\max k}\right\} \Big/ Q_{\max i} \qquad \text{(Expression 1)}$$

$$\Theta = \sum^{N} Q_{\max k} \times \Theta_k \Big/ \sum^{N} Q_{\max k}.$$

If the load factor of a compressor in capacity-controlled operation reduces, the discharge pressure of the compressor is gradually decreased from the maximum discharge pressure $P_{max}$ as $P_{max3} \rightarrow P_{max2} \rightarrow P_{max1}$ in accordance with the load factor Θ. At this time, the pressure of each of the other compressors in full load operation changes in the same manner as that of the compressor in capacity-controlled operation because they communicate through the discharge side piping $C_d$ with the compressor in capacity-controlled operation.

An amount of reduction of the discharge pressure is determined as follows. A storage section of the parent controller $B_1$ stores in advance the maximum flow rates $Q_{max1}$ to $Q_{max4}$ of the respective screw compressors $A_1$ to $A_4$. The storage section of the parent controller $B_1$ also stores data of piping pressure loss $P_{LOSS}$ from the discharge sides $d_1$ to $d_4$ of the compressors $A_1$ to $A_4$ to the unit inlets $s_1$ to $s_5$ of the demander when all compressors $A_1$ to $A_4$ in the screw compressor system are in full load operation.

The load factor Θ of the whole screw compressor system is calculated using (Expression 1) and then the piping pressure loss $P_L$ at the load factor Θ is calculated using the following expression:

$$P_L = P_{LOSS} \times \Theta^k \qquad \text{(Expression 2)}$$

where k is an index for adjusting the piping pressure loss $P_L$ in accordance with the sort of pressure loss different due to the variation in kind of device disposed between the screw compressors $A_1$ to $A_4$ and the units $u_1$ to $u_5$ of the demander 5. From this piping pressure loss $P_L$, the difference $\Delta P_L$ in piping pressure loss is obtained using the following expression:

$$\Delta P_L = P_{LOSS} - P_L \qquad \text{(Expression 3).}$$

It is found that, when the load factor has the value Θ, the screw compressor system can suitably be operated at the pressure lower by $\Delta P_L$ than that at the maximum load factor. The piping pressure loss difference $\Delta P_L$ at each load factor is calculated using the above expressions (1) to (3) and the obtained pressure loss differences $\Delta P_L$ are transmitted to the respective child controllers $B_2$ to $B_4$.

Figure 4:
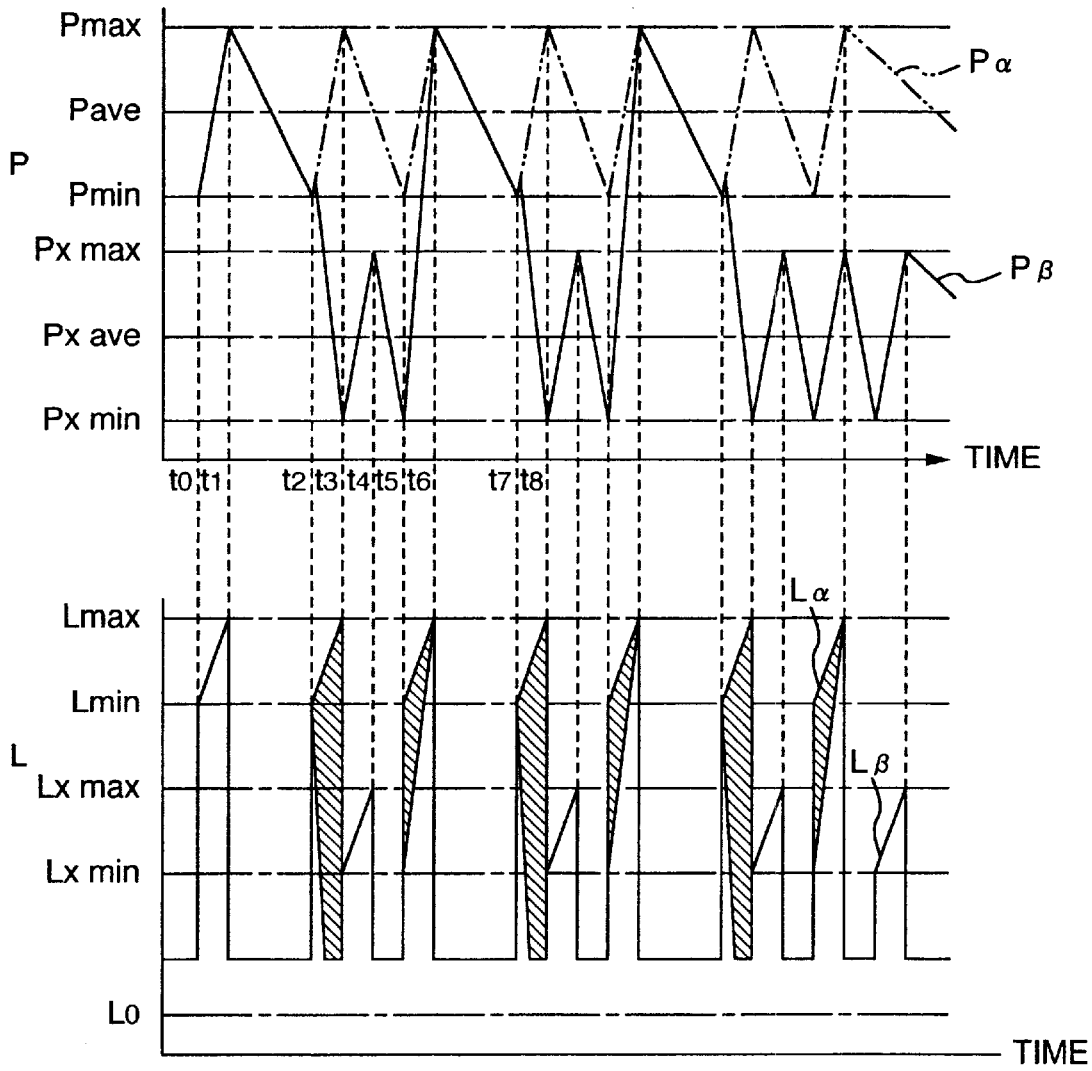
FIG. 4 is a graph illustrating the relation between discharge side pressure and change in power with time in an embodiment of the present invention.

FIG. 4 shows a specific example for explaining this process. Suppose that there is only the minimum pressure $P_{min}$ necessary for the demander 5 at time $t_0$. In this case, since gas is consumed in the demander 5, the compressor for capacity control is changed in its operation condition from no-load operation to load operation. At this time, the discharge pressure measured by the corresponding pressure gauge rises from $P_{min}$ to $P_{max}$. In this drawing, an average pressure of $P_{min}$ and $P_{max}$ is represented by $P_{ave}$. When the discharge pressure reaches the maximum pressure at time $t_1$, the compressor for capacity control changes in its operation condition from load operation to no-load operation.

At time $t_2$, since the discharge pressure reaches the minimum pressure, the parent controller tries to change the operation condition of the compressor for capacity control from no-load operation to load operation. However, the load factor has reduced though not shown in FIG. 4, so the parent controller changes the set values for the discharge pressure. More specifically, although the load operation start pressure and the no-load operation start pressure of the compressor for capacity control have been set at $P_{min}$ and $P_{max}$, the parent controller lowers these set values to $P_{xmin}$ and $P_{xmax}$, respectively. As a result, the discharge pressure measured on the discharge side of the compressor for capacity control changes as shown by line $P_\beta$ in FIG. 4 though it changes as shown by line $P_\alpha$ in a conventional control method.

In the example of FIG. 4, at time $t_5$, since the load pressure has risen, the minimum set value and the maximum set value of the discharge pressure of the compressor for capacity control are returned to $P_{min}$ and $P_{max}$, respectively. After this, the control as described above is repeated.

FIG. 4 shows, in its lower part, change in shaft power L of the screw compressor system when the discharge pressure changes as shown in the upper part. When the load factor Θ is in the vicinity of 100%, the shaft power L changes between the minimum value $L_{min}$ and the maximum value $L_{max}$ respectively corresponding to the set minimum value $P_{min}$ and the set maximum value $P_{max}$ of the discharge pressure ($L_\alpha$). When the load factor has reduced and the set minimum and maximum values of the discharge pressure have been changed to $P_{xmin}$ and $P_{xmax}$, respectively, the shaft power L changes accordingly between the minimum value $L_{xmin}$ and the maximum value $L_{xmax}$ ($L_\beta$). Thus the shaft power can be reduced by an amount corresponding to the hatched area in FIG. 4 in comparison with the case wherein the set values of the discharge pressure are not changed.

In the above embodiment, the gas consumption in the demander 5 is used for calculating the load factor. The gas consumption is known with a flow meter provided in the discharge piping system $C_d$. However, since such a flow meter is expensive in case of a large-capacity screw compressor system, flow rate is generally calculated from time periods measured with each of the timers $T_1$ to $T_4$ provided in the parent controller $B_1$ and the child controllers $B_2$ to $B_4$. More specifically, when the load factor $\Theta_i$ of the compressor for capacity control is high, the compressor for capacity control is in load operation for a long time and in no-load operation in a short time. Inversely, when the load factor $\Theta_i$ of the compressor for capacity control is low, the compressor for capacity control is in load operation for a short time and in no-load operation in a long time.

So, by measuring the switching cycle, the result is made to correspond to the load factor. When the time in no-load operation is $\Delta t_2$ and the time in load operation is $\Delta t_1$, the cycle time $\Delta t$, which is the switching cycle, is expressed by the following expression:

$$\Delta t = \Delta t_1 + \Delta t_2$$

The timer $T_1$ provided in the parent controller $B_1$ measures this cycle time $\Delta t$ and $\Delta t_1$ and $\Delta t_2$ and the parent controller $B_1$ judges as to whether or not the time $\Delta t$ is within the set range of $\Delta t_{min}$ to $\Delta t_{max}$. If the switching cycle At is too short in comparison with the set range, on/off-operations of each control valve for switching are frequent and wear and tear of each control valve occurs. For this reason, the switching cycle $\Delta t$ is preferably not less than the set minimum value.

On the other hand, if the switching cycle $\Delta t$ is more than the set maximum value, it indicates that the gas consumption is either extremely much or extremely little in comparison with the capacity of the screw compressor system. The quantity of gas consumption can be determined from the ratio of load operation to no-load operation. Thus the case wherein the gas consumption is extremely little is known from the ratio of load operation to no-load operation and the cycle time. In this case, for the same reason as above, it is preferable to lower the maximum value of the discharge pressure and thereby reduce excessive power being used. On the other hand, even if the cycle time is long, when the ratio of load operation is high, the discharge pressure is not lowered because the gas consumption is much.

Figure 5:
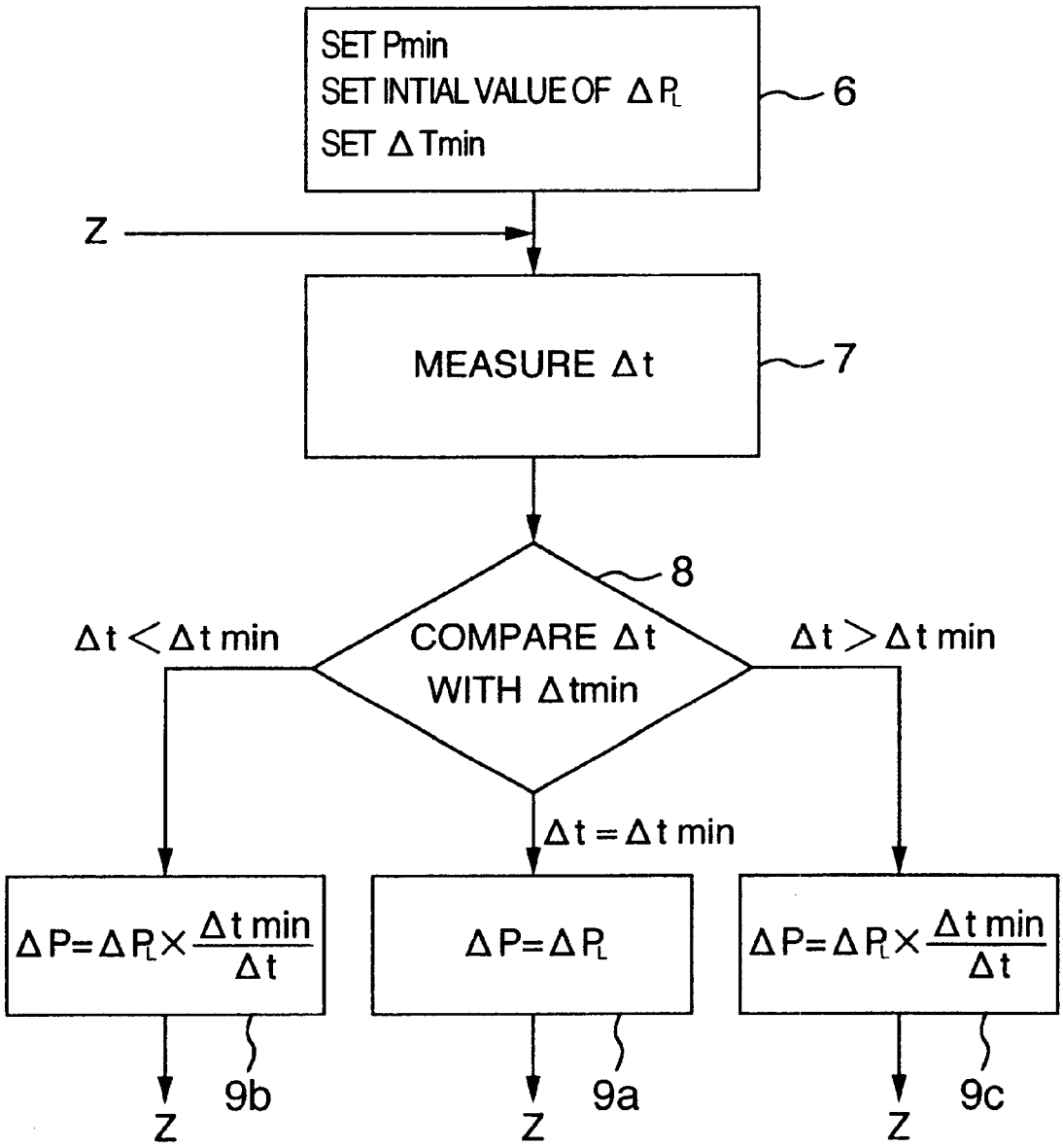
FIG. 5 is a flowchart illustrating a control flow in a screw compressor system according to the present invention.

FIG. 5 shows a flow of the control for measuring the cycle time and changing the discharge pressure. This flow is carried out by the parent controller $B_1$. Initially set is the minimum pressure $P_{min}$, at which the operation condition changes from no-load operation to full load operation. In relation to this, the maximum pressure $P_{max}$, at which the operation condition changes to no-load operation, is then set using an initially set value of the piping pressure loss difference $\Delta P_L$. Further, also set is the minimum switching time $\Delta t_{min}$ determined in consideration of the life time of each of control parts such as control valves used in the screw compressor system (step 6). The screw compressor system is then operated and the cycle time $\Delta t$ in accordance with the gas consumption in the demander is measured (step 7). In measuring this cycle time $\Delta t$, a mean value obtained by a plurality of measurements is used to eliminate influence by accidental change and the like.

Next, the measured cycle, time $\Delta t$ is compared with the minimum value $\Delta t_{min}$ of the cycle time set in advance (step 8). If the measured cycle time $\Delta t$ is equal to the set minimum value $\Delta t_{min}$, any set value is not changed (step 9*a*). Either if the measured cycle time $\Delta t$ is less than the set minimum value $\Delta t_{min}$ (step 9*b*) or if the measured cycle time $\Delta t$ is more than the set minimum value $\Delta t_{min}$ (step 9*c*), the maximum set pressure $P_{max}$ is changed in accordance with the following expression:

$$P_{max} - P_{min} = \Delta P_x = \Delta P_L \times \Delta t_{min} / \Delta t \quad \text{(Expression 4).}$$

The above operation is repeated (step Z). By this manner, the pressure difference $\Delta P_x$ between the minimum set pressure $P_{min}$ and the maximum set pressure $P_{max}$ can be controlled into the necessary minimum value. By transmitting these data to the child controllers $B_2$ to $B_4$, variation range of the discharge pressures on the screw compressors $A_1$ to $A_4$ sides can be narrowed.

Figure 6A:
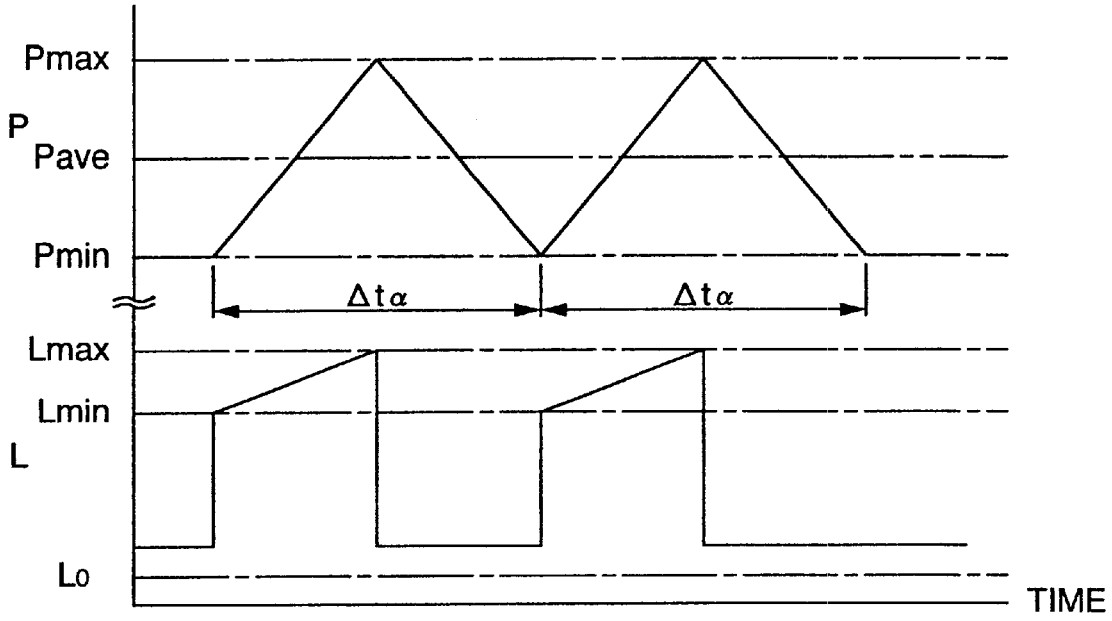
FIG.6A PRIOR ART
FIG. 6A is a graph showing change in discharge pressure in case of a conventional load/no-load type compressor operation control.
Figure 6B:
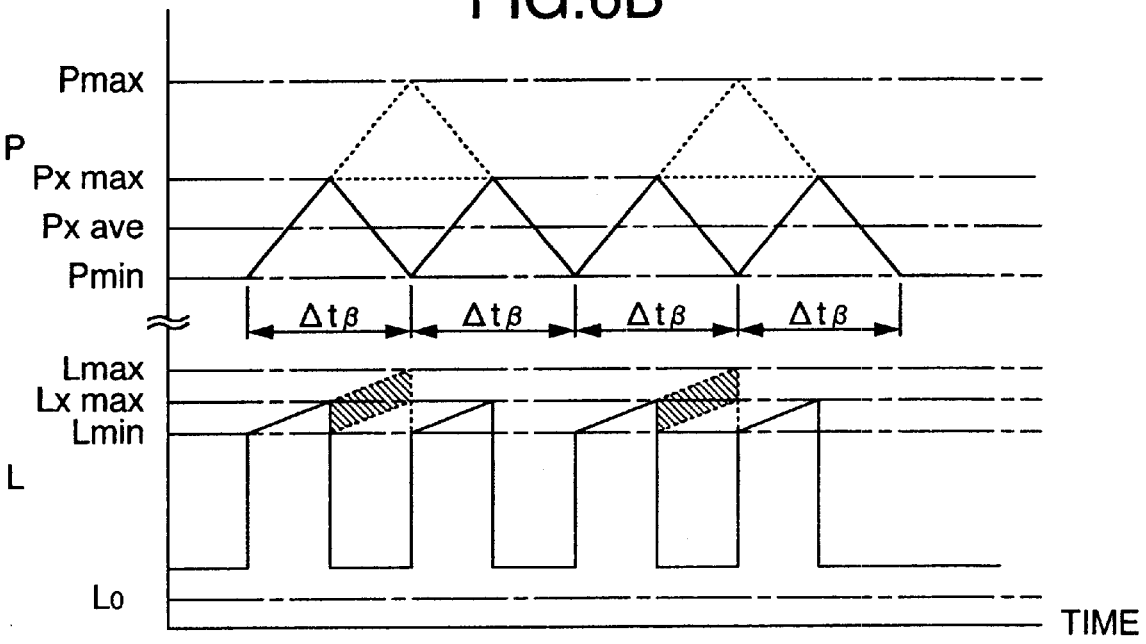
FIGS. 6B and 7 are graphs illustrating change in discharge side pressure in other embodiments of screw compressor systems according to the present invention.

FIG. 6 shows another embodiment of the present invention. In this embodiment, the minimum set pressure $P_{min}$ is not changed and only the maximum set pressure $P_{max}$ is changed. The minimum set pressure $P_{min}$ is limited by the necessary pressure for the units $u_1$ to $u_5$ of the demander 5. For this reason, there is a case wherein the minimum set pressure $P_{min}$ is difficult to change. This embodiment provides a power reducing method for such a case. FIG. 6A shows change in discharge pressure in case of a conventional load/no-load type compressor operation control. The cycle time $\Delta t$ is $\Delta t_\alpha$, which is out of the set range of $\Delta t_{min}$ to $\Delta t_{max}$. So, as shown in FIG. 6B, in order to set the cycle time within the set range of $\Delta t_{min}$ to $\Delta t_{max}$, the maximum set pressure is set at $P_{xmax}$ lower than $P_{max}$. As a result, the cycle time becomes $\Delta t_\beta$ shorter than $\Delta t_\alpha$ and thereby power can be reduced by an amount corresponding to the hatched area between $L_{max}$ and $L_{min}$.

Figure 7:
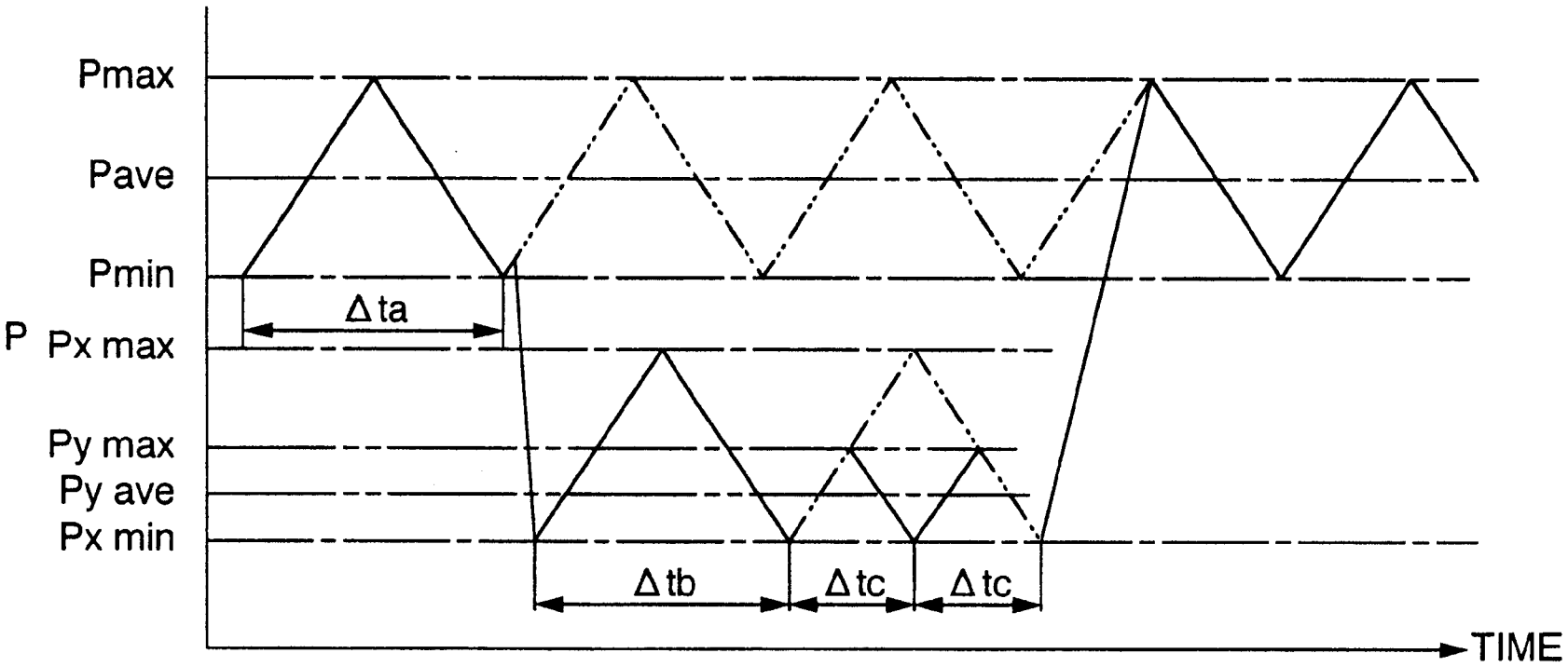

FIG. 7 shows still another embodiment of the present invention. This embodiment is a combination of the above-described two embodiments. More specifically, this embodiment comprises a first stage wherein either of the maximum and minimum set pressures on the compressor discharge side is changed in accordance with the load factor and a second stage wherein only the maximum set pressure is changed when the minimum set pressure reaches its limit of setting. Because the gas consumption has reduced, the maximum set pressure is changed from $P_{max}$ to $P_{xmax}$ and the minimum set pressure is also reduced from $P_{min}$ to $P_{xmin}$. As a result, the cycle time has changed from $\Delta t_a$ to $\Delta t_b$. However, even when the cycle time $\Delta t$ is $\Delta t_b$, it is longer than the permissible range. So, in order to set the cycle time at $\Delta t_c$, within the permissible range, the maximum set pressure is further reduced from $P_{xmax}$ to $P_{ymax}$. By this manner, like the above-described embodiments, the shaft power of the screw compressor system can be reduced.

In the above-described embodiments, used are one parent screw compressor, three child screw compressors, and five units of the demander. But, it is needless to say that the number of screw compressors and the number of demander units are not limited to that example. Besides, although a pressure gauge on the discharge side is provided for each screw compressor, only one pressure gauge may be provided if it can measure the pressure between the discharge piping of the screw compressors and the piping to the demander units. Besides, although a timer is also provided for each controller, only one timer may be provided. Further, although the parent controller and the parent screw compressor are fixed, the parent controller and the parent screw compressor may be changed in accordance with the number of compressors to be operated. Besides, compressors operated and stopped may be properly changed to make the operation times of the screw compressors even, thereby reducing the frequency of maintenance of the screw compressor system. Further, although the compressors have the same capacities in the above-described embodiments, it is needless to say that a plurality of compressors having different capacities may be used in combination.

In short, the above embodiments described in this specification are merely for exemplifying and they are never to limit the present invention. The present invention includes any modification within the true spirit and scope of the present invention.

According to the above embodiments, the discharge pressure range of the screw compressor system is automatically controlled in accordance with the load factor corresponding to the gas consumption in the demander so that the switching time period for switching between full load operation and no-load operation is set within a predetermined switching time period range. Thus the average operational pressure can be reduced. As a result, the operational power can be reduced and power-saving becomes possible.

As described above, according to the present invention, the discharge pressure of each compressor is controlled in accordance with the load factor that corresponds to the compressed gas consumption in a demander. Thus excessive compressor power can be reduced to realize power-saving.

What is claimed is:

1. A screw compressor system comprising a plurality of screw compressors the capacities of each of which is controlled by repeating load operation and no-load operation, and control means for determining the number of screw compressors to be operated in accordance with compressed gas consumption in a demander, putting, in the screw compressors to be operated, all second screw compressors other than one first screw compressor in load operation, putting said first screw compressor in no-load operation when a maximum value of discharge pressure is reached, putting said first screw compressor in load operation when a minimum value of discharge pressure is reached and changing the maximum and minimum values of discharge pressure of each of the first and second screw compressors in accordance with a load factor of said first screw compressor.

2. The system according to claim 1, wherein, when the load factor of said first screw compressor has reduced, said control means reduces the minimum value of discharge pressure for load operation start and the maximum value of discharge pressure for no-load operation start respectively to be less than a rated minimum value of discharge pressure for load operation start and a rated maximum value of discharge pressure for no-load operation start predetermined in relation to the first screw compressor.

3. The system according to claim 2, wherein, when the reduced minimum value of discharge pressure for load operation start is beyond a predetermined lower limit, said control means sets the minimum value of discharge pressure load operation start to that lower limit.

4. The system according to claim 2, wherein, when period from a load operation of said first screw compressor to a subsequent load operation of said first screw compressor is out of a predetermined time range, said control means reduces the maximum value of discharge pressure for no-load operation start of the first screw compressor to be less than the predetermined rated maximum value of discharge pressure for no-load operation start.

5. A screw compressor system comprising one parent screw compressor to be put in load operation and no-load operation, at least one child screw compressor connected through piping to a discharge side of the parent screw compressor and to be put in load operation and no-load operation, a parent controller for controlling the parent screw compressor, a child controller provided for each child screw compressor and connected to the parent controller, discharge pressure measuring means attached to one of a discharge side piping of said parent screw compressor and a piping extending from that piping to introduce discharge gas to a demander, and a timer provided in at least one of said parent and child controllers for measuring a cycle time of load operation and no-load operation, wherein said parent controller obtains a load factor on the basis of a cycle time measured by said timer, determines the number of screw compressors to be operated in accordance with that load factor, puts one screw compressor among the screw compressors determined to be operated in load operation, controls the remaining one to repeat load operation when a minimum value of discharge pressure is reached and no-load operation when a maximum value of discharge pressure is reached, obtains a load factor on the basis of a cycle time newly measured by said timer as for said one screw compressor, and changes the minimum and maximum values discharge pressure in accordance with said load factor.

6. The system according to claim 5, wherein said parent controller controls said one screw compressor so that the minimum and maximum values of discharge pressure are lowered when the load factor reduces.

7. An operating method of a screw compressor system in which discharge sides of a plurality of screw compressors to be put in load operation and no-load operation are made to communicate with each other, said method comprising:

obtaining a load factor from a cycle time between load operation and no-load operation obtained by operating all screw compressors;

determining the number of screw compressors to be operated on the basis of said load factor;

operating one of the screw compressors to be operated to repeat load operation when a minimum value of discharge pressure is reached and no-load operation when a maximum value of discharge pressure is reached;

operating the remaining screw compressors of the screw compressors to be operated in load operation;

in relation to said screw compressor repeating load operation and no-load operation, newly measuring a cycle time to obtain another load factor; and changing the minimum and maximum values of discharge pressure of said screw compressor repeating load operation and no-load operation in accordance with said another load factor.

8. The method according to claim 7, wherein the minimum value of discharge pressure for load operation start and the maximum value of discharge pressure for no-load operation start of said screw compressor repeating load operation and no-load operation are lowered as the load factor reduces.

9. The method according to claim 8, wherein, when the minimum value of discharge pressure for load operation start of said screw compressor repeating load operation and no-load operation has reached a predetermined lower limit pressure, the minimum value of discharge pressure for load operation start is set at said lower limit value and the maximum value of discharge pressure for no-load operation start is changed.

10. The method according to claim 7, wherein said the minimum and maximum values of discharge pressure are controlled by a parent controller provided for one of a plurality of compressors included in the screw compressor system.

11. The method according to claim 10, wherein said parent controller controls child controllers respectively provided for said remaining screw compressors.

* * * * *

UNITED STATES PATENT AND TRADEMARK OFFICE

CERTIFICATE OF CORRECTION

PATENT NO. : 6,599,094 B2
DATED : July 29, 2003
INVENTOR(S) : Kanazaki et al.

It is certified that error appears in the above-identified patent and that said Letters Patent is hereby corrected as shown below:

Title page,
Item [73], should read as follows:
-- [73] Assignee: Hitachi, Ltd., Tokyo (JP); T-Tec Co., Ltd., Ibaraki-ken (JP) --

Signed and Sealed this

Eleventh Day of November, 2003

JAMES E. ROGAN
*Director of the United States Patent and Trademark Office*